United States Patent [19]

Morrell

[11] 3,971,226

[45] July 27, 1976

[54] PRESTRESSED ROOF SUPPORT SYSTEM

[75] Inventor: Roger J. Morrell, Bloomington, Minn.

[73] Assignee: The United States of America as represented by the Secretary of the Interior, Washington, D.C.

[22] Filed: Oct. 31, 1975

[21] Appl. No.: 627,650

[52] U.S. Cl. ..... 61/45 B; 299/11

[51] Int. Cl.[2] ..... E21D 21/00

[58] Field of Search ..... 61/45 R, 45 B, 42, 39; 299/11, 33, 31; 52/223, 229, 230; 254/29 A

[56] References Cited

UNITED STATES PATENTS

| | | | |
|---|---|---|---|
| 1,630,589 | 5/1927 | Taber | 299/11 |
| 3,306,051 | 2/1967 | Howlett | 61/45 B |
| 3,722,158 | 3/1973 | Dykmans | 52/230 X |
| 3,738,071 | 6/1973 | Finsterwalder | 61/45 B X |
| 3,910,546 | 10/1975 | Connors | 254/29 A X |

FOREIGN PATENTS OR APPLICATIONS

| | | | |
|---|---|---|---|
| 222,320 | 7/1962 | Austria | 52/230 |
| 1,266,152 | 3/1972 | United Kingdom | 52/230 |

*Primary Examiner*—Dennis L. Taylor
*Attorney, Agent, or Firm*—Thomas Zack; Donald R. Fraser

[57] ABSTRACT

A method of providing roof support by the use of prestressed support members. Sequentially the method calls for the drilling of a series of generally parallel holes in a mine roof such that they extend from one underground cavity to another; inserting support members like metal cables or rods into each of these holes to extend completely through the hole's entire length between the cavities; pretensioning each of said supports; forcing a liquid binder around the supports while in their holes; and releasing the forces on the supports after the binder has become cured by solidifying.

5 Claims, 6 Drawing Figures

PRESTRESSED ROOF SUPPORT SYSTEM

BACKGROUND OF THE INVENTION

1. Field of the Invention:

The invention described herein is an improved method to provide roof support for mining operations.

2. Description of the Prior Art:

Various methods have been suggested in the past to provide roof support for areas to be subsequently mined out. In the U.S. Pat. No. 3,527,500 to C. R. Thompson boreholes are drilled from the surface to the areas to be mine and then filled with a solidifying material. Steel rods may also be placed in this material to give added strength before the material solidifies into a pillar type support. Another method, more closely analogous to the present invention, is described in the U.S. Pat. No. 1,630,589 to W. P. Taber. This latter reference discloses horizontal roof supports being inserted before excavation takes place. To do this holes are bored or drilled at or near the top of the mineral vein and beams are inserted in each hole. Supports like the mineral to be mined out can be used and/or a reclaimable posts may be used to vertically hold the inserted beams in place.

Both of these prior art method of support differ substantially from my invention. Thompson is concerned with drilling vertically holes from the earth's surface to form underground pillar supports that have steel supporting rods. My invention is concerned with generally horizontal roof supports totally underground that have prestressed rods bonded in the roof holes. As such the drilling required is not determined or limited by the distance beneath the earth's surface mining operation are to take place. Taber does not drill from one subterranean cavity to another or use prestress rods as self supporting roof supports but depends on vertical supports, whether artificial or the material to be mined, as the method to hold the embedded horizontal roof supports. This would not only result in more obstacles in the mine to be avoided by workers and equipment but also would not allow the recovery of the total amount of material possible when the vertical supports of Taber are the material to be mined. More important, it would require miners to be in the area before mining operations take place to set up the artificial vertical supports, whereas, in my invention the roof supports are inserted weeks or even months before the miners are actually working beneath a supported roof. This advantage prevents many of the minor roof falls from occurring and thus eliminates or reduces one of the major causes of death and injury in mines. These and other advantages of my invention over the prior art will become more apparent as the following description of the invention is read.

SUMMARY OF THE INVENTION:

The mine roof support method forming the subject matter of this invention requires the following steps: drilling generally horizontal holes from one underground cavity to another; inserting support members in each of the holes such that they extend from one cavity to the other; pretensioning these in situ supports; forcing a liquid binder material between each support and its hole; and, once the binder material has become cured by solidifying or otherwise, then releasing the force causing the rods to become pretensioned.

The primary object of this invention is a new and safer improved method of providing roof support for an underground mine to allow increased productivity therein.

BRIEF DESCRIPTION OF THE DRAWINGS:

The FIGS. 1*a* to 1*d* show the basic steps used to practice my invention in the order to be undertaken beginning with FIG. 1*a*.

Before getting into the details of the invention it would perhaps be useful to its full understanding to explain some related background material. The particular area where this invention would find its best use would be with mines having massive rock roof formations where the rocks contain many generally vertical planes of weakness such as caused by joint, fractures, or fault. With such a formation the commonly used rock bolts supports could be eliminated. The advantages of eliminating the installation of rock bolts are safety and installation time. Safety is achieved by eliminating the requirement, as in rock bolt installation, of the miners having to go into the area to be mined before mining operations take place. Further, as these roof supports are installed before mining operations occur, when the miners do in fact start operations they have overhead support protection. Time is saved since it is generally quicker to practice the method of this invention than to conduct mining operations which call for the installing of the multitude of roof supporting rock bolts required.

Like installing rock bolts this invention can be classified as a temporary roof support mining operation. It also has in common with rock bolts the objective of preventing normal average roof falls not the rare massive types of falls that are almost impossible to prevent. However, it is these average roof falls involving small rocks normally no more than a few feet across that statistically cause the vast majority of deaths and injuries due to rock falls in mines. It should also be clear that this invention is not applicable to every type of mine formation to provide roof support thereto. For example, if the roof was composed of very weak rocks or materials, other types of supports would be preferred and, even if the roof were composed of hard rocks, if it had very strong horizontal laminations rocks bolts would most likely provide the most reliable support.

Figure 1B:
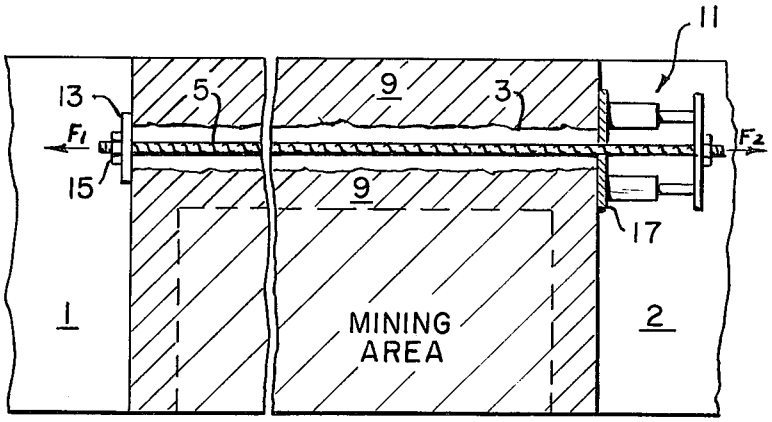
Figure 1D:
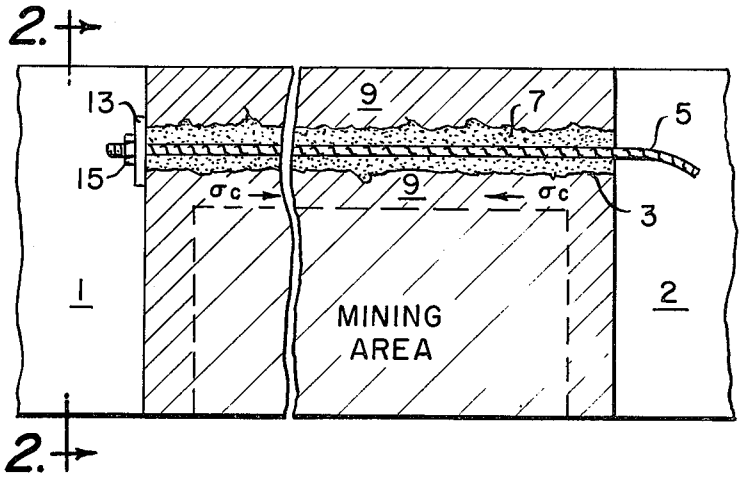
Figure 1A:
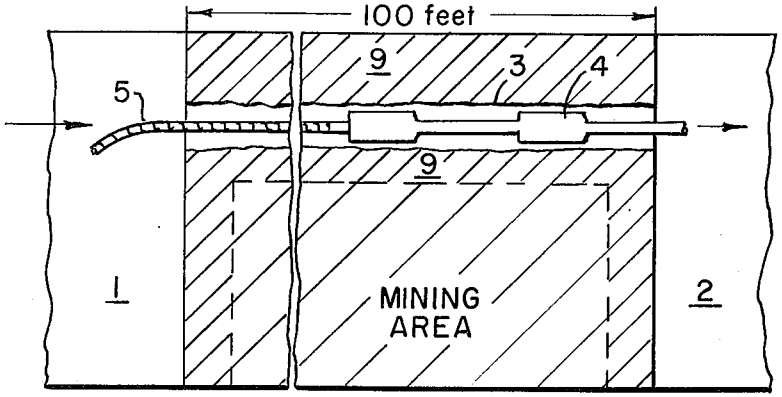
Figure 1C:
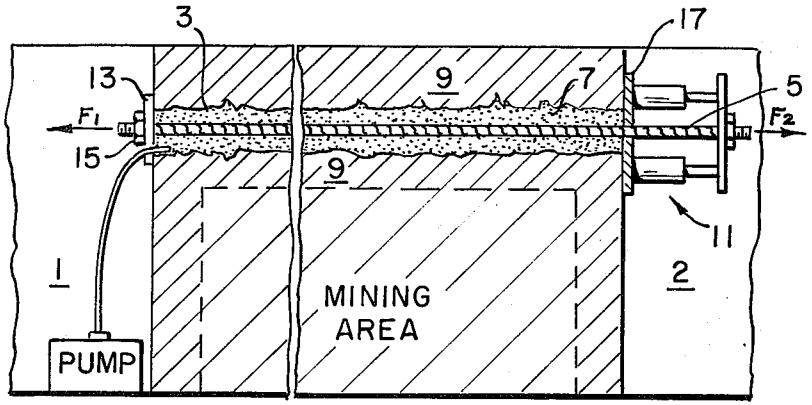

FIGS. 1*a* to 1*d* show the sequence of steps to be taken to practice the invention as viewed from the cable's lengthwise direction between two internal subterranean cavities designated by the numbers 1 and 2. Initially, as indicated in FIG. 1*a*, the roof support member 5 made of a steel rod, cable, or the like is pulled through a previously drilled hole 3 which interconnects the two mine cavities. This can be accomplished by attaching the cable to the drill steel 4 as the drill steel is withdrawn from the completed hole. Typically, the distance X between the two cavities can vary from ten feet on upwards. Distances of around 100 feet are more or less the desired distance. The diameter of hole 3 can, of course, also vary with 2 inches being about the normal size taking into consideration the diameter of the supporting member and cost of drilling.

After the hole has been drilled and the cable inserted such that it extends throughout the hole's entire length from one cavity to the other, a square cable anchoring plate 13 having a retaining nut 15 is placed on one of the threaded support ends. FIG. 1*b* illustrates this set up. At the other end of the cable a suitable tensioning device 11 places a force $F_2$ thereon which results in a opposite and equal force $F_1$ being applied at the plate 13 end. One type of tensioning device that can be employed to tension the cable is a center hole hydraulic jack such as used for setting rock bolts or for tensile testing of rock bolts.

Once the desired tension has been placed on the rod or cable, the next step is to fill the cavity (see FIG. 1*c*) between the cable and the wall of hole 3 with a suitable liquid binder 7, such as a grout, epoxy resin, plastic adhesive, or other liquid agent which firmly bonds the cable to the walls of the hole 3 as it sets or hardens. Cracks, crevices, and similar irregularities within the rock formation making up the hole walls are filled by this liquid as it is forced into the hole. A small hole (not shown) in either end plate 13 or end plate 17 can be used as an entrance for a conduit connected to a pump that forces the liquid filler agent around the cable as depicted.

Depending upon the setting or curing time of the liquid binder agent used, the next step (FIG. 1*d*) is to release the tension causing device 11 once the agent becomes fully set or hardened. When this happens the support member whether it be a cable or a rod member trys to assume its original unstressed length. This snap back action is opposed by the roof rocks through the bond formed by the binding agent such that horizontal compressive stresses $\sigma c$ are induced in the roof rocks towards each other. These stresses along with the strength provided by the support cable or rod and the filler agent tend to close up vertical plane in the roof rocks, increase the friction between adjacent roof rocks, and tie together loose blocks of roof rocks. All of these actions result in a strengthened and reinforced roof 9. Mining operations can then take place in the area immediately below the support members.

Figure 2:
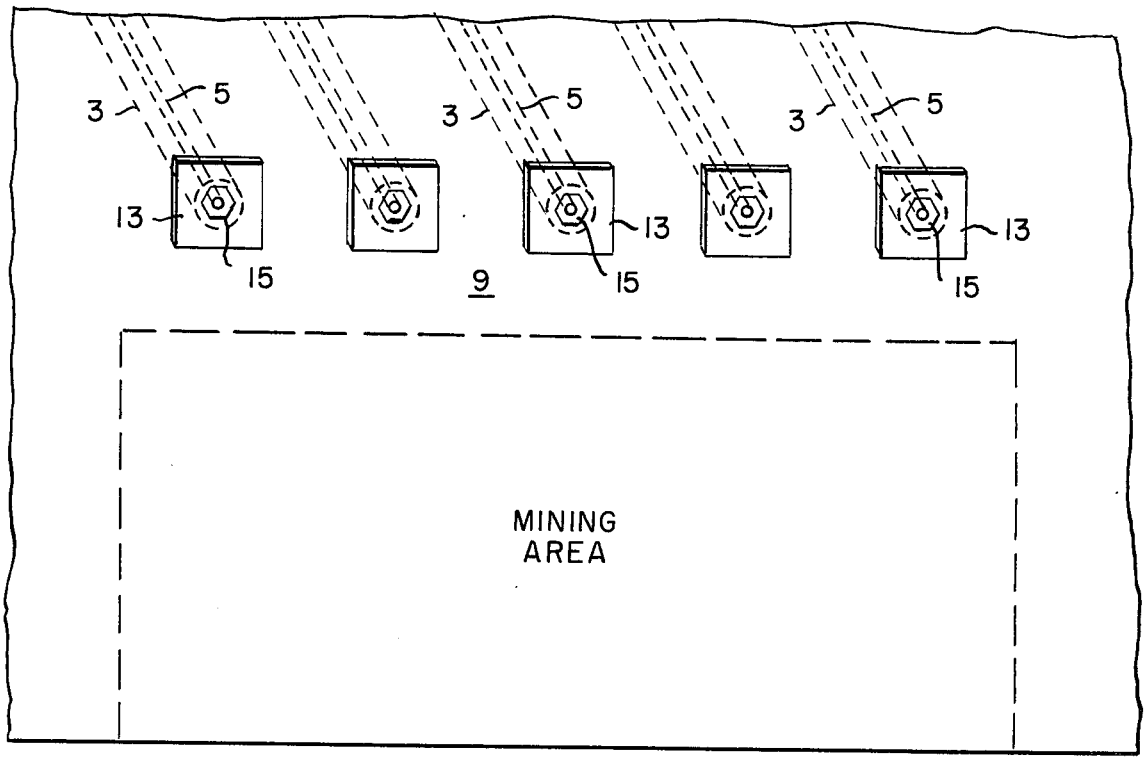
FIG. 2 is an end view of a series of the installed in situ cables as view from a mine cavity in the direction of the arrow in FIG. 1*d*.
Figure 3:
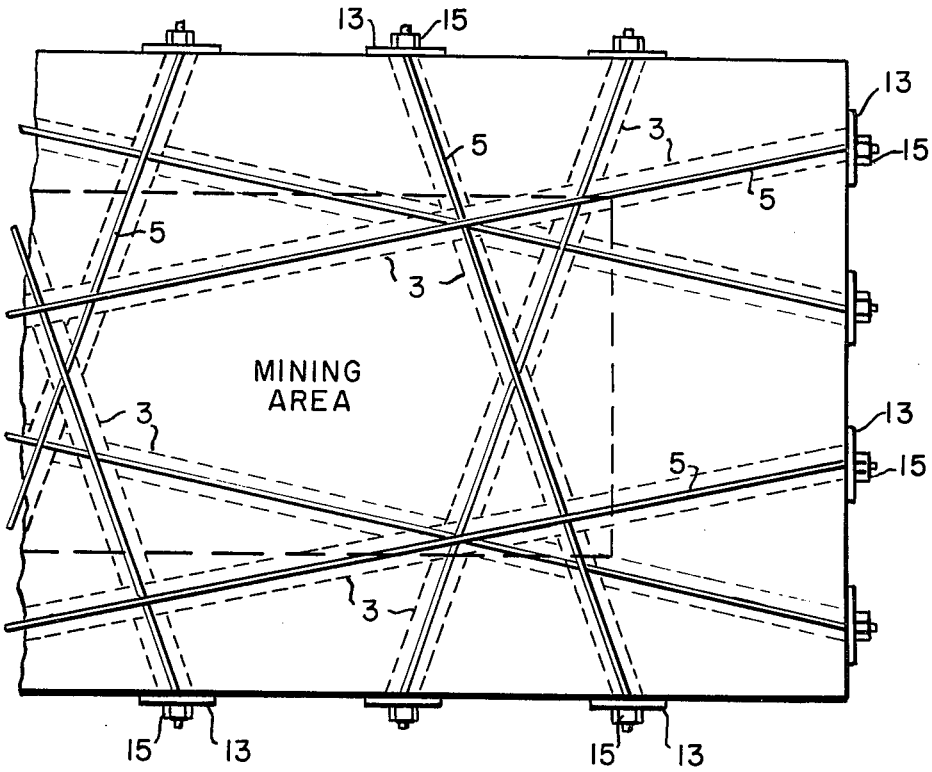
FIG. 3 is a modification of the basic parallel support set up shown in cross-section from above.

FIG. 2 illustrates an end view of a series of support cables or rods as viewed from the left cavity in FIG. 1*d*. Each cable had been installed as described with respect to FIG. 1*a* to 1*d*. This series of cables is usually generally horizontal to each other and coplanar. Typically the cables are spaced about 4 to 6 feet apart (distance $\gamma$ in FIG. 2) and parallel to each other. As described, this system may be used by itself or if, the situation warrants, in conjunction with other support techniques, like rock bolts, to increase its effectiveness. The series of generally horizontal cables or rods used for supporting members need not always be parallel to each other or coplanar as shown in FIG. 3. They may be installed at angles or in a basket weave, criss-cross or other pattern at different planes subject to the rock formation orientation. The criss-cross pattern is illustrated by the cross-sectional top view of their placement in FIG. 3. Although these supports appear to intersect in actuality they should not intersect each other. Being in different horizontal planes the drill holes actually cross over each other when viewed from above. Variations may also be made in the way the hole is drilled i.e., it need not be perfectly straight but may be curved. These placement adjustments to the basic method will be determined by the rock formations present in an instant situation.

None of these specific variations or the disclosed preferred embodiment itself should be used to limit the scope and extent of my invention which is to be measured only by the claims which follow.

I claim:

1. A method for supporting a mine roof between two mine cavities comprising the steps of:

drilling a series of generally horizontal holes above the area to be worked, each of said drilled holes extending from one mine cavity to a distant mine cavity;

inserting an elongated support member into each of said holes such that it extends lengthwise from one of said cavities to the other cavity;

pretensioning of said support members while fully inserted in the holes and extending between said two cavities by first firmly anchoring one end of said member near one hole cavity;

forcing a liquid filler bonding agent between each of the walls of said holes and said support while inserted in its hole; and releasing said pretension applied to said support member after said bonding agent sets to bond the support member to the wall of its hole.

2. The method of claim 1 wherein said drilling step takes place at a distance of at least ten feet and the series of generally horizontal holes are each generally coplanar ane lengthwise parallel to each other.

3. The method of claim 2 wherein the orientation and and size of the particular rock formation determines the distance between any two adjacent parallel supports, said distance being at least one foot.

4. The method of claim 1 wherein said forcing step takes place by use of a pump in one of said cavities having a conduit connected to said hole.

5. The method of claim 1 wherein said series of generally horizontal holes are drilled in different planes such that they appear to intersect each other when viewed in cross section from above.

* * * * *